US012161215B2

(12) United States Patent
Malouf et al.

(10) Patent No.: US 12,161,215 B2
(45) Date of Patent: Dec. 10, 2024

(54) ATTACHABLE POUCH FOR PROTECTIVE CLOTHING

(71) Applicants: Kathleen Elizabeth Malouf, Red Bank, NJ (US); James Christopher Malouf, Red Bank, NJ (US)

(72) Inventors: Kathleen Elizabeth Malouf, Red Bank, NJ (US); James Christopher Malouf, Red Bank, NJ (US)

( * ) Notice: Subject to any disclaimer, the term of this patent is extended or adjusted under 35 U.S.C. 154(b) by 290 days.

(21) Appl. No.: 17/731,199

(22) Filed: Apr. 27, 2022

(65) Prior Publication Data

US 2023/0346110 A1 Nov. 2, 2023

(51) Int. Cl.
*A45F 3/00* (2006.01)

(52) U.S. Cl.
CPC ..... *A45F 3/005* (2013.01)

(58) Field of Classification Search
CPC ..... Y10T 403/7005; Y10T 403/7007; A61B 2050/3015; A61B 2050/301; A45F 3/005; A45F 2003/144
USPC ..... 224/660; 403/348–349
See application file for complete search history.

(56) References Cited

U.S. PATENT DOCUMENTS 1,339,309 A * 5/1920 Waltz ..... A44B 11/24 24/189
3,769,733 A * 11/1973 Nelson ..... F42B 39/02 224/931
4,119,249 A * 10/1978 Hanson ..... A45C 11/00 224/679
4,541,556 A * 9/1985 Collins ..... B26B 29/025 206/250
4,620,653 A * 11/1986 Farrell ..... A45F 5/02 224/664
4,656,673 A 4/1987 Easton et al.
5,255,833 A * 10/1993 McAllister ..... A45F 3/02 224/236
5,737,775 A 4/1998 Schwartz
5,857,600 A * 1/1999 Akutsu ..... A24F 15/12 224/268
6,056,412 A * 5/2000 Atlee ..... G08B 5/004 362/108
6,435,392 B1 * 8/2002 Kennedy ..... A45C 11/22 224/676
6,641,015 B2 * 11/2003 Huggins, Jr. ..... A45F 5/021 224/678

(Continued)

FOREIGN PATENT DOCUMENTS

CN 211882406 U 11/2020

*Primary Examiner* — Adam J Waggenspack

(57) ABSTRACT

Disclosed herein is an attachable pouch configured for use with protective clothing, such as a disposable protective medical clothing. The pouch includes a pouch portion and a back portion. The pouch portion includes a first side and a second side opposite the first side, and a bottom portion disposed between the first side and the second side. The first side, second side, and bottom portion define an opening. The pouch portion has a top edge and a bottom edge extending in a same direction as the top edge. A first flange extends outward from the first side and a second flange extends outward from the second side. The back portion includes a central portion and a peripheral portion surrounding the central portion. A first strap and a second strap are attached to the peripheral portion. The first flange and the second flange are attached to the peripheral portion.

17 Claims, 5 Drawing Sheets

(56) References Cited

U.S. PATENT DOCUMENTS

| | | | | |
|---|---|---|---|---|
| 7,258,259 | B1 * | 8/2007 | Owens | F41C 33/041 224/912 |
| 10,828,209 | B2 * | 11/2020 | Song | D04H 1/46 |
| 2004/0065703 | A1 * | 4/2004 | Bellucci | A45F 3/20 224/660 |
| 2011/0067169 | A1 | 3/2011 | Compton et al. | |
| 2011/0185477 | A1 | 8/2011 | Olenicoff | |
| 2013/0243354 | A1 * | 9/2013 | Lytle | A45C 3/001 383/59 |
| 2016/0015103 | A1 | 1/2016 | Gray | |

* cited by examiner

ATTACHABLE POUCH FOR PROTECTIVE CLOTHING

TECHNICAL FIELD

Examples of the present disclosure generally relate to an attachable pouch configured for use with protective medical clothing.

BACKGROUND

Healthcare providers (HCPs) have the potential for exposure to biological fluids and other hazards that are capable of transmitting diseases. Nonsterile, disposable non-surgical medical gowns, which are used for routine patient care in healthcare settings, are appropriate for use by HCPs when caring for patients with suspected or confirmed exposure to pathogens.

During their routine process of providing care, HCPs may carry medical equipment and supplies. However, the design of protective clothing that shields HCPs and patients from harmful microorganisms and contaminants is not fabricated with pockets or other mechanism to hold supplies, thus increasing the burden of HCPs.

Accordingly, there is a need for a device capable of holding supplies while wearing protective clothing.

SUMMARY

An attachable pouch configured for use with protective clothing, such as a disposable protective medical clothing, is disclosed herein. In one example, the pouch includes a pouch portion and a back portion. The pouch portion includes a first side and a second side opposite the first side, and a bottom portion disposed between the first side and the second side. The first side, second side, and bottom portion define an opening. The pouch portion has a top edge and a bottom edge extending in a same direction as the top edge. A first flange extends outward from the first side and a second flange extends outward from the second side. The back portion includes a central portion and a peripheral portion surrounding the central portion. A first strap and a second strap are attached to the peripheral portion. The first flange and the second flange of the pouch portion are attached to the peripheral portion of the back portion.

In another example, a pouch includes a pouch portion and a back portion. The pouch portion includes a first side, a second side opposite the first side, and a bottom portion disposed between the first side and the second side. The first side, second side, and bottom portion define an opening. A top edge and a bottom edge extend in a same direction as the top edge. The top edge is curved and has a nadir with a height that is lower than each corner of the top edge. A first flange extends outward from first side and a second flange extends outward from the second side of the pouch portion. The back portion has a central portion and a peripheral portion surrounding the central portion. A first strap and a second strap are attached to the peripheral portion. The first flange and the second flange of the pouch portion are attached to the peripheral portion of the back portion. The height of the nadir is shorter than a height of the back portion.

BRIEF DESCRIPTION OF THE DRAWINGS

So that the manner in which the above-recited features of the present disclosure can be understood in detail, a more particular description of the disclosure, briefly summarized above, may be had by reference to examples, some of which are illustrated in the appended drawings. It is to be noted, however, that the appended drawings illustrate only exemplary examples and are therefore not to be considered limiting of the scope of the disclosure, as the disclosure may admit to other equally effective examples. To facilitate understanding, identical reference numerals have been used, where possible, to designate identical elements that are common to the figures. It is contemplated that elements and features of one example may be beneficially incorporated in other examples without further recitation.

DETAILED DESCRIPTION

Disclosed herein is an attachable pouch configured for use with protective clothing, such as a disposable protective medical clothing. The protective medical clothing includes non-surgical gowns (i.e., isolation gowns), coveralls and surgical gowns. Isolation gowns are intended to protect the wearer from the transfer of microorganisms and bodily fluids in low- or minimal-risk patient isolation situations. Isolation gowns are non-surgical gowns that used to protect the wearer from contact and droplet precaution diseases and pathogens, such as influenza, pneumonia, and COVID-19.

Because isolation gowns are disposable, the gowns are worn on top of personal protective equipment (PPE), such as medical scrubs. As such, the isolation gowns cover the pockets of the scrubs. Health Care Professionals (HCPs) wearing isolation gowns are thus forced to carry supplies, medication, and equipment into isolation environments, make multiple trips into and out of the isolation environment, or rely upon additional HCPs to carry supplies. However, because the isolation environments are often under negative pressure in order to contain any contaminants within the environment, each exit from the isolation environment creates an opportunity for airborne or blood-borne pathogens to escape the that environment, thus creating an opportunity for contamination to spread outside of the protected environment.

Advantageously, the attachable pouch enables HCPs to bring all supplies, medications, and equipment into the room to accomplish as many tasks as possible in one trip. By reducing the frequency of trips into and out of the isolation environment, opportunities for contaminants to escape the environment are advantageously reduced. Additionally, supplies are conserved as fewer isolation gowns are utilized, and fewer supplies are dropped and thereby conserved.

Figure 1:
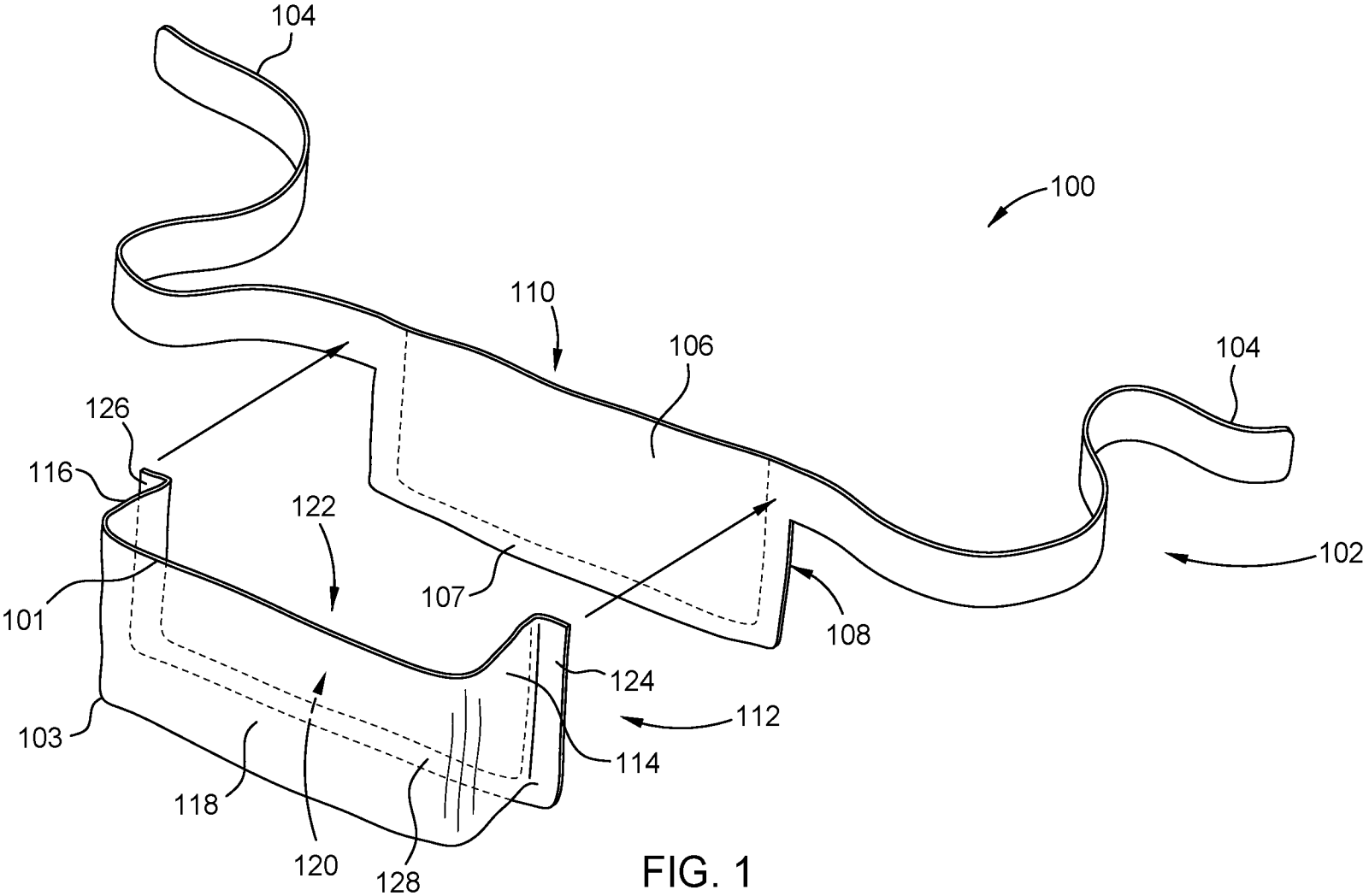
FIG. 1 is an exploded perspective view of an attachable pouch having a back portion and a pouch portion.

FIG. 1 is a perspective view of an attachable pouch 100 having a back portion 102 and a pouch portion 112. The back portion 102 has a front side 108 and a back side 110 that is opposite the front side 108. The back portion 102 includes a central portion 106 disposed between straps 104. The central portion 106 is much wider than the straps 104. The central portion 106 and straps 104 may by fabricated from a single piece of material. A peripheral portion 107 surrounds the central portion 106. In one or more examples, the straps 104 are flexible.

The pouch portion 112 has a first side 114 and a second side 116 opposite the first side 114. A front side 118 of the pouch portion 112 connects the first side 114 and the second side 116. A bottom side 120 is connected to the first side 114, second side 116, and front side 118. An opening 122 is defined by the first side 114, second side 116, and the bottom side 120. A top edge 101 of the pouch portion 112 extends from the first side 114 through the front side 118 to the second side 116. Similarly, a bottom edge 103 extends in a same direction as the top edge 101, extending along the first side 114, second side 116, and front side 118. The top edge 101 can be substantially parallel to the bottom edge 103, although pouch portion 112 is not limited to this configuration. In another example, the top edge 101 and bottom edge 103 are not parallel, as shown by the dashed line in FIG. 1.

The first side 114 is terminated by a first flange 124. The first flange 124 has a height that is substantially the same as the first side 114 and a length that extends beyond the bottom side 120. The first side 114 terminates at the bottom side 120. A second flange 126 terminates the second side 116 and extends beyond the bottom side 120. Similarly, the second flange 126 has a height that is substantially the same as the second side 116, and a length that extends beyond the bottom side 120. An optional third flange 128 extends from the bottom side 120, in a manner similar to the other flanges 124, 126. The pouch portion 112 is attached to peripheral portion 107 of the back portion 102 via the flange the flanges 124, 126. In some examples, the optional third flange 128 is attached to the peripheral portion 107. In one example, adhesives are used to secure the back portion 102 to the flanges 124, 126, 128 of the pouch portion 112. Other techniques may be utilized to secure the back and pouch portions 102, 112. Suitable materials for the pouch portion 112 and/or the back portion 102 include thermo-formed polymer materials such as high-impact polystyrene, polycarbonate, polyvinyl chloride, royalite, thermoplastic polyolefin, vinyl, and the like.

In one example, the pouch portion 112 is made from a sonically weldable material, such as a plastic, and more specifically a thermoplastic, which is a largely amorphous compound with little or no crystalline structures. Advantageously, a sonic weld is formed without adhesive or fasteners and creates a high strength, gas- and water-tight bond between the pouch portion 112 and the back portion 102. Suitable examples of the plastic include acrylic, polycarbonate, acrylonitrile butadiene styrene (ABS), and the like. In some examples, the pouch portion 112 is transparent, thus enabling a user to readily view the contents of the pouch portion 112. The back portion 102, can be made from a same or a different material as the pouch portion 112. As such, the back portion 102 can be made from a thermoplastic, which can be sonically welded to the pouch portion 112 also made of a thermoplastic material. Alternatively, the back portion 102 can be made from a different material than the pouch portion 112. For example, the back portion 102 can be made from a spunbond polypropylene fabric, or a high-density spunbond polymer fiber. In another example, the pouch portion 112 is made of the same material as the back portion 102. In some example, the material of the pouch portion 112 is formed by blister or vacuum forming a plastic material. Forming the pouch portion 112 in this manner substantially prevents the pouch portion 112 from collapsing onto the back portion 102, thus enabling the interior of the pouch 100 to be more readily accessible to the user.

In another example, the flanges 124, 126 can be heat welded to back portion 102. Heat welding can advantageously enable crystalline or non-amorphous polymers to be utilized as the material of the pouch portion 112. Examples of crystalline polymers include polyethylene (PE) and polypropylene (PP), and the like, which may also be spunbound.

In another example, the flanges 124, 126 attach to the back portion 102 by one of riveting, sewing, or adhesive bonding. Advantageously, when the back portion 102 is attached to the pouch portion 112 by riveting, sewing, or adhesive bonding, the pouch portion 112 can be fabricated from a wide variety of materials. The pouch portion 112 can be between about 10 inches and about 5 inches in length, such as about 8 inches, or about 7 inches, or about 6 inches. The height of the pouch portion 112 can be between 7 inches and about 3 inches, such as about 6 inches, or about 5 inches, or about 4 inches. A depth of the pouch portion can be between about 3 inches and about 0.5 inches, such as about 3 inches, or about 2 inches, or about 1 inch, or about 0.5 inches.

Figure 2:
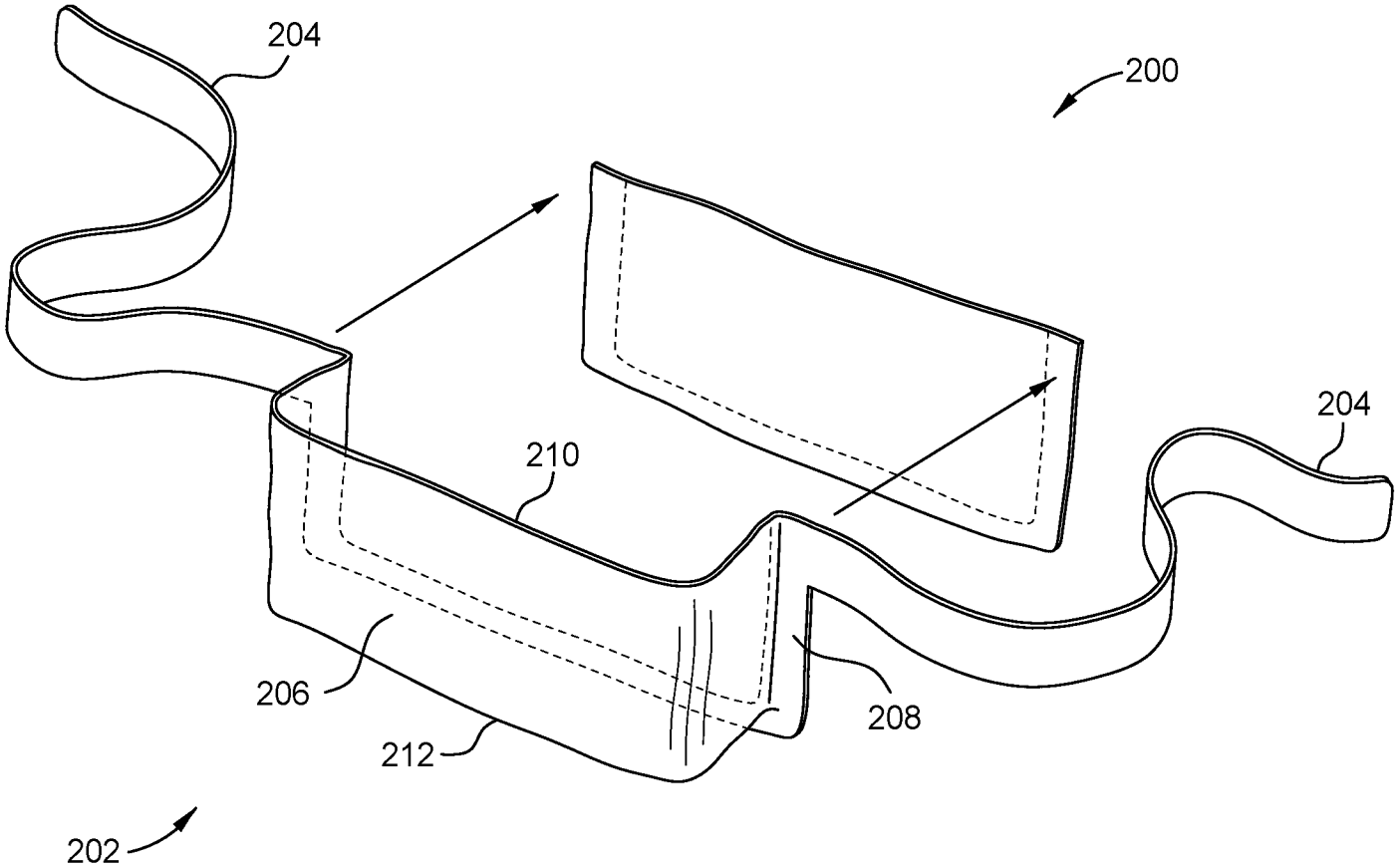
FIG. 2 is an exploded perspective of another example of the attachable pouch shown in FIG. 1.

FIG. 2 illustrates a perspective of another example of an attachable pouch 200. The pouch 200 has a pouch portion 202 and a back portion 214 that is attachable to the pouch portion 202. A central portion 206 is surrounded by a periphery 208.

Straps 204 are attached to the periphery 208 of the pouch portion 202, and in one example, the straps 204 and pouch portion 202 are fabricated from a single piece of material. The straps 204 extend outward from the periphery 208 of the pouch portion 202. The back portion 214 can be separately manufactured from a material having greater rigidity than the pouch portion 202 and the straps 204, which thus holds the pouch portion 202 in an open state.

For example, the back portion 214 can be made from a thin, rigid structure, such as a rigid plastic, or paperboard such as card stock. In some examples, the paperboard is coated in order to provide a more uniform surface for the pouch portion 202 to attach thereto. The coating on the back portion 214 can also provide a water-resistant surface that contains leaks from liquid supplies or medicines within the pouch 200 when the pouch portion 202 and back portion 214 are attached to one another.

A top edge 210 of the pouch portion 202 is opposite a bottom edge 212. The top edge 210 and bottom edge 212 may not be parallel as shown by the dashed line. For example, the top edge 210 can be bowed, such that corners of the top edge 210 at the periphery 208 extend longer in a vertical direction than the top edge 210 in the central portion 206 of the pouch portion 202. Top edge 210 is curved, such that that the top edge 210 has a nadir 306 with a height that is lower than each corner of the top edge 210 proximate the periphery 208. The height of the nadir is shorter than a height of the back portion 214. In this manner, configuring the top edge 210 as a bowed edge (i.e., curved) reduces the likelihood of items stored in the pouch portion 202 from snagging or tearing the material of the pouch portion 202. In addition, items stored in the pouch portion 202 are more visible when the pouch portion 202 is not made of a transparent material. The back portion 214 can be attached to the periphery 208 of the pouch portion 202, as described above. In one example, the back portion 214 is reflective to better illuminate the contents of the pouch 200.

Figure 3:
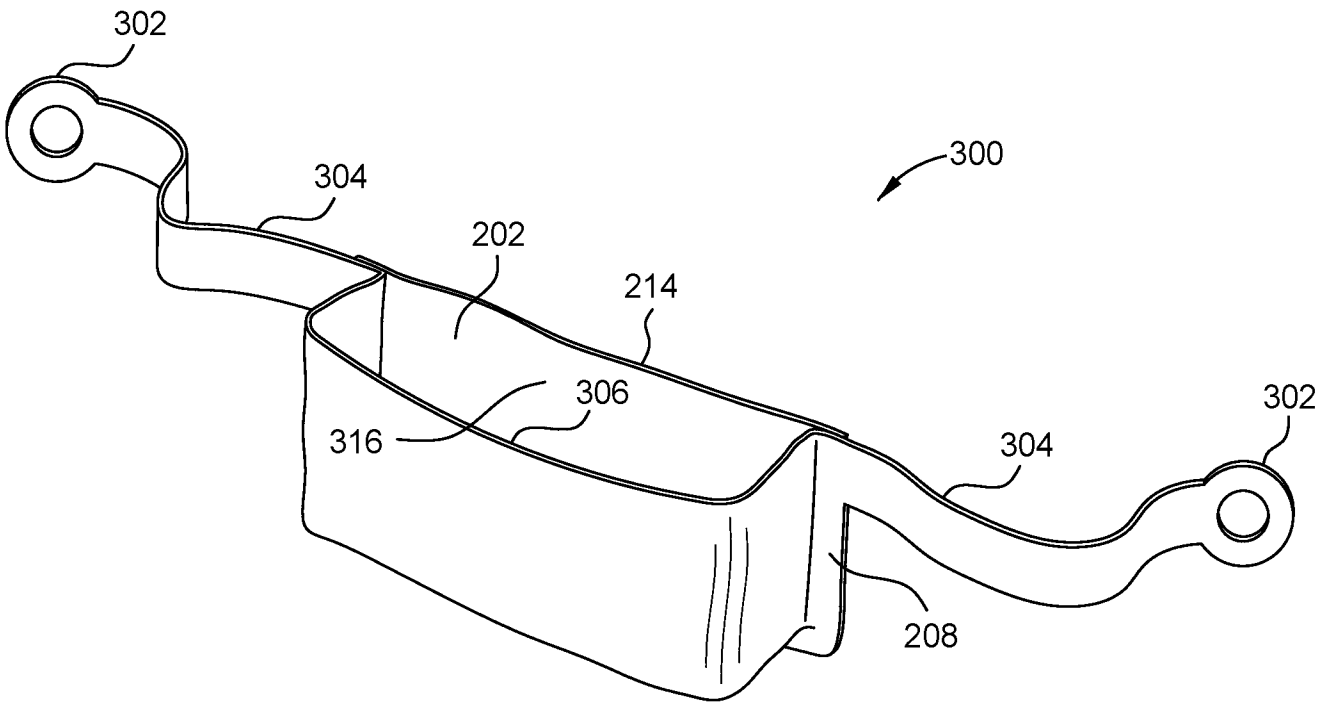
FIG. 3 is a perspective view another example of an attachable pouch having a loop attached at a terminal end of each strap.

FIG. 3 is a perspective view the attachable pouch 300 having a loop 302 attached at a terminal end of each strap 304. The pouch 300 is substantially similar to the pouch 200 shown in FIG. 2, having the same back portion 214 and pouch portion 202. A diameter of an interior of each loop 302 is configured to enable a strap or tie of a protective gown to pass therethrough and secure the pouch portion 202 to the strap or tie. As such, a thickness of each strap 304 and the diameter of each loop 302 can be set according to a thickness of the tie or strap to which the pouch 300 is attached. While the loop 302 is shown attached to the pouch 300 shown in FIG. 3, the loop 302 can be also be attached to the straps 104 shown in FIG. 1. It is understood that the loops 302 can be formed on the straps 104, 204 shown in FIGS. 1 and 2, without departing from the scope of this disclosure. In one or more examples, the straps 304 are flexible.

Figure 4A:
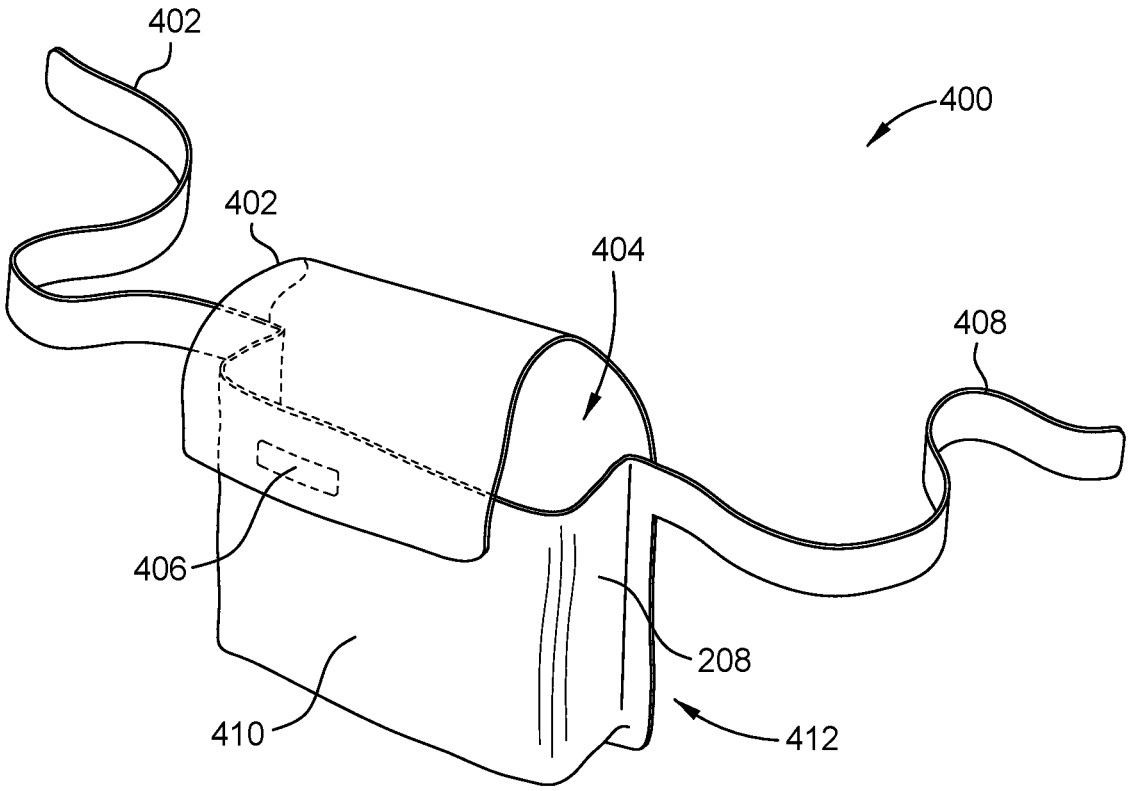
FIG. 4A is a perspective view of a pouch portion having a cover configured to fold over an opening of the pouch portion.

FIG. 4A is a perspective view of a pouch portion 400 having a cover 402 configured to fold over an opening 404. The pouch portion 400 may be constructed as described for any of the pouches disclosed herein or similarity constructed, but also includes the cover 402. A back side 412 of the pouch portion 400 is opposite the front side 410. As described in greater detail above with respect to FIG. 2 straps 204 are attached to the periphery 208 of the pouch portion 400.

A fastener 406 is shown disposed on a front side 410 of the pouch portion 400 and is configured to face an interior surface of the cover 402. The fastener 406 attaches the cover 402 to the front side 410, closing the opening 404 and thereby securing any contents of the pouch portion 400. Alternatively, the fastener 406 is disposed on the interior surface of the cover 402, such that the fastener 406 faces the front side 410 of the pouch portion 400. In yet another example, the fastener 406 is a two-piece part, having a first part on the interior surface of the cover 402 and a second part disposed on an exterior of the front side 410.

Figure 4B:
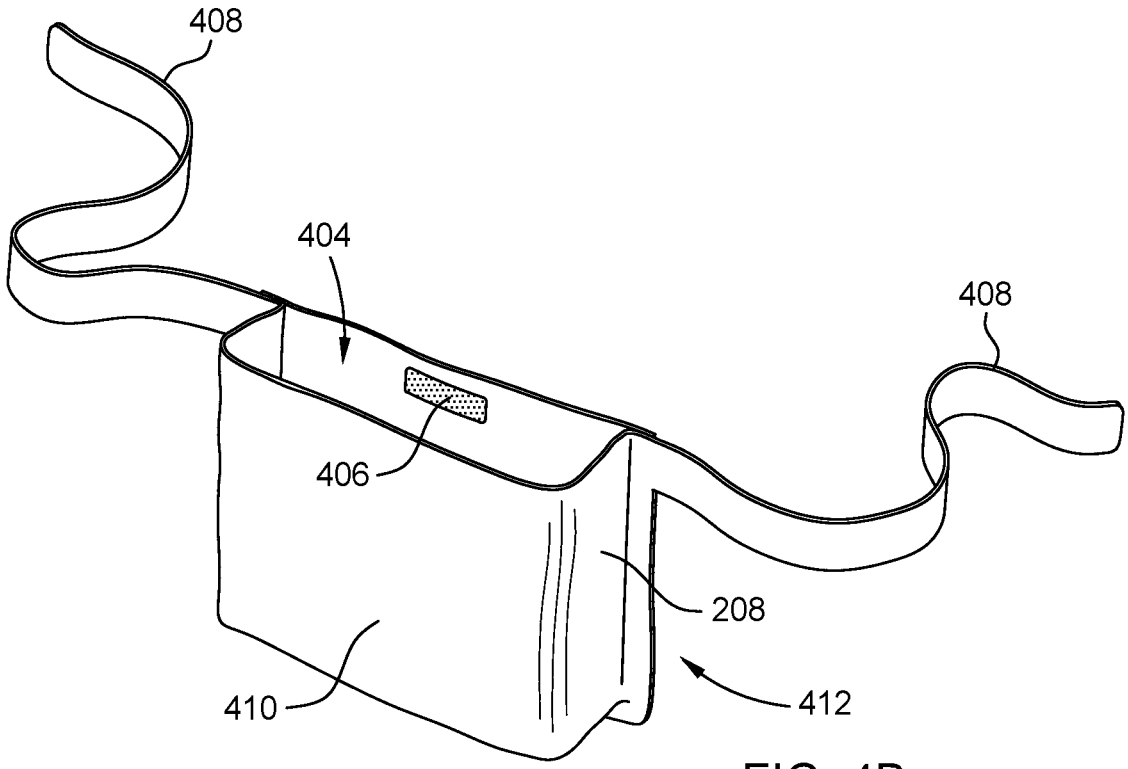
FIG. 4B, is another perspective view of the pouch portion having a fastener disposed on an interior surface of the pouch portion.

In yet another example, shown in FIG. 4B, the pouch portion 400 has a fastener 406 disposed on an interior surface of the pouch portion 400, such as the interior surface of the back side 412. In another example, the fastener 406 can be disposed on the interior surface of the front side 410 of the pouch portion 400. Alternatively, a part of the fastener 406 is disposed on the interior surface of each of the sides 410, 412. In one example, the fastener 406 is an adhesive strip. In another example, when the fastener 406 is a two-piece part, the fastener 406 can be a hook and loop mechanism, such as Velcro®. Naturally, the fastener 406 can be disposed on any of the pouches disclosed herein, including pouches 100, 200, and 300 shown in the preceding figures.

Figure 5C:
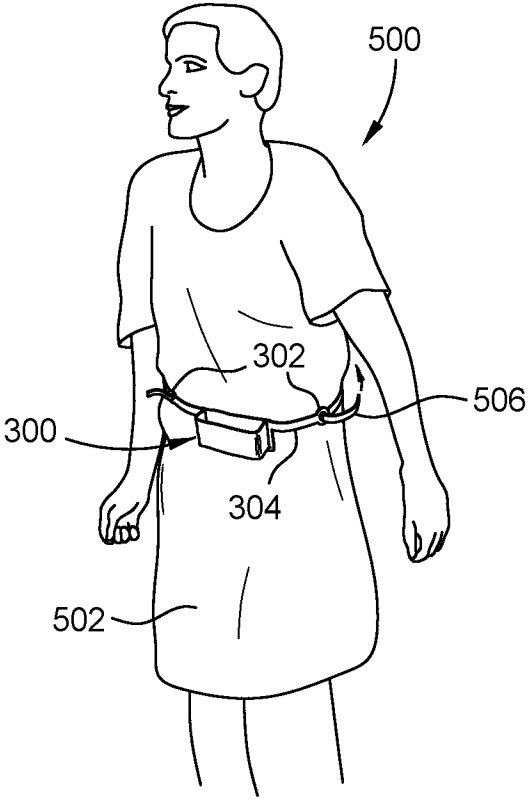
FIG. 5C shows the attachable pouch of FIG. 3 attached to the protective garment.
Figure 5B:
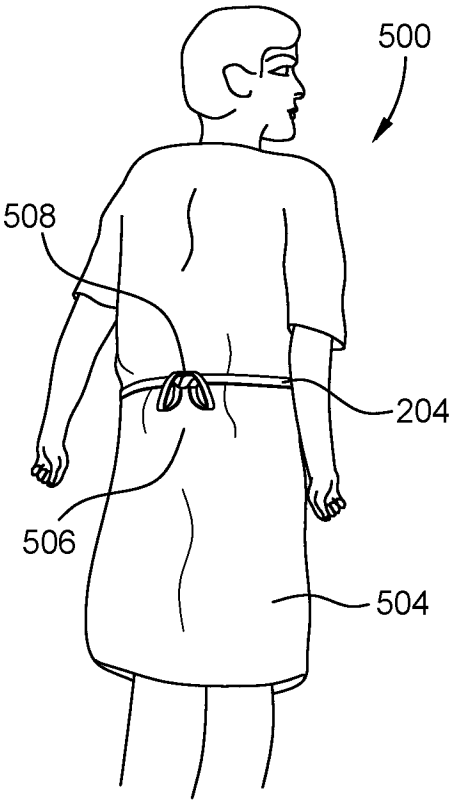
FIGS. 5A and 5B show the attachable pouch of FIG. 2 attached to a protective garment.
Figure 5A:
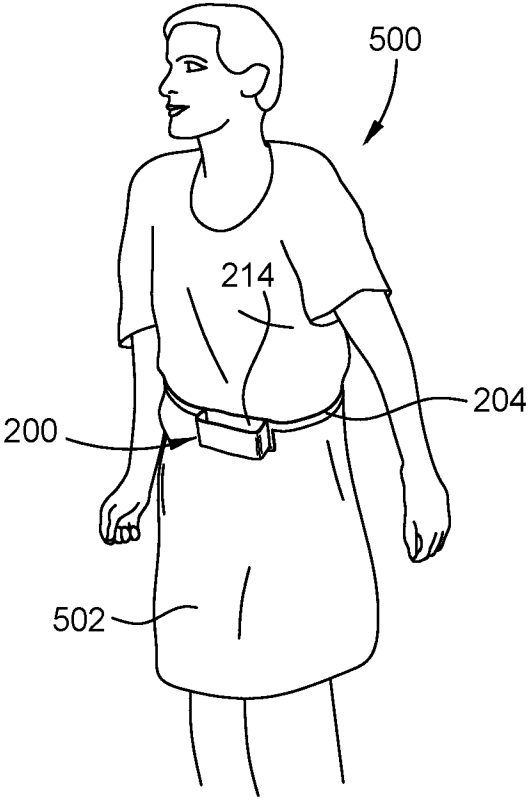

FIGS. 5A-5B show the attachable pouch 200 of FIG. 2 as attached to a front 502 of a protective garment 500 that is worn by a user (not shown). The pouch 200 is worn with the back portion 214 against the front 502 of the protective garment 500. The straps 204 have a length sufficient to surround the protective garment 500 and secure the pouch 200 by attaching the straps 204 together in a back 504 of the protective garment 500. The straps 204 are flexible. Accordingly, the lengths of the straps 204 are sufficient to encircle a medical gown (i.e., the protective garment 500) when in use. For example, the straps 204 can be tied in a knot 508, as shown. The other pouches may similarly be configured.

FIG. 5C shows the attachable pouch 300 of FIG. 3 attached to the front 502 of the protective garment 500 utilizing ties 506. The loops 302 are configured to interact with the ties 506 of the protective garment 500, such that each one of the ties 506 passes through a respective loop 302 providing sufficient friction for the ties 506 and straps 204 to be maintained in tension. The pouch 300 is securely attached to the protective garment 500 by passing the ties 506 through the loops 302 and drawing the ties 506 in tension with the straps 204. The ties 506 can also be secured in knot 508 on the back 504 of the protective garment 500.

Because the straps 104, 204, 304 secures the pouch 100, 200, 300, 400, to the protective garment 500 by using tension in the straps 104, 204, 304 and/or ties 506, the tension can be adjusted according to the weight of the contents carried in the pouch 100, 200, 300, 400. Otherwise stated, the pouches 100, 200, 300, 400 are adaptively secured to the protective garment 500. Attaching a conventional pocket directly to a garment via an adhesive does not enable the pocket to be adaptively secured to the garment based upon the contents of the pocket. Instead, a manufacturer must determine the adhesive based upon anticipated contents of the pouch and anticipate the materials to which the adhesive is configured to attach. If the strength of the adhesive is too low, the pouch will not secure to the garment, and in contrast. Additionally, the use of straps allows the pouch to be rotated to different positions while on the user, thus allowing the pouch to be rotated out of the way if necessary without detaching the pouch from the user.

Advantageously however, the pouches 100, 200, 300, 400 disclosed herein are configured to adaptively secured to the protective garment 500 based upon the contents of the pouch 100, 200, 300, 400. Pouches 100, 200, 300, 400 secured to protective garment 500 via straps 104, 204, 304 enable a broader range of industrial applications. For example, the pouches 100, 200, 300, 400 can be used in the security industry contents such as mobile phones, wallets, and keys can be placed into a clear pouch 100, 200, 300, 400 enabling the user to retain personal possessions while enabling security professionals to examine the contents. In another example, the pouches 100, 200, 300, 400, can be used in sterile environments, such as scientific and medical laboratories where contents can be temporarily handled and stored on the user's garment without sacrificing sterility of the environment. In yet another non-limiting example, it is contemplated that the pouches 100, 200, 300, 400, can be utilized by operators in electronic cleanrooms, where the pouches 100, 200, 300, 400 can be configured to hold items in an antistatic state, thus substantially reducing the risk of electrostatic discharge that would otherwise be caused by the contents of the pouch.

Disclosed herein is an attachable pouch configured for use with protective clothing, such as a disposable protective medical clothing. Advantageously, the attachable pouch enables a wearer to adjustably secure items within the pouch to a user's garment without using an adhesive that can damage the garment. While the foregoing is directed to examples of the present disclosure, other and further examples may be devised without departing from the basic scope thereof, and the scope thereof is determined by the claims that follow.

What we claim is:

1. A pouch comprising:

a pouch portion comprising:

a first side and a second side opposite the first side, and a bottom portion disposed between the first side and the second side, the first side, second side, and bottom portion defining an opening;

a top edge and a bottom edge extending in a same direction as the top edge, wherein a distance between the first side and the second side is greater than a distance between the top edge and a bottom edge;

a first flange extending outward from the first side of the pouch portion;

a second flange extending outward from the second side of the pouch portion, wherein the pouch portion is made of a transparent material and formed by blister or vacuum forming a plastic material;

a back portion comprising a central portion and a peripheral portion surrounding the central portion; and a first strap and a second strap attached to and extending outward from the peripheral portion, wherein the first flange and the second flange are attached to the peripheral portion, wherein the first strap, the second strap, and the central portion are integrated into one continuous piece and are formed from a single piece of material, the central portion is wider than the first strap and the second strap, wherein the pouch portion is configured to not collapse onto the back portion, and wherein the first strap and second strap form a waist strap for securing the pouch to a person.

2. The pouch of claim 1, wherein the pouch portion further comprises:

a third flange extending from the bottom portion, the third flange attached to the peripheral portion of the back portion.

3. The pouch of claim 1, wherein the first flange and the second flange enable the pouch portion to attach to the back portion by one of riveting, welding, or adhesive bonding.

4. The pouch of claim 1, wherein the pouch portion is made of high-density spunbond polyethylene fibers.

5. The pouch of claim 1, wherein the pouch portion further comprises:

a loop at a terminal end of the first strap and the second strap.

6. The pouch of claim 1, wherein the pouch is configured to attach to a disposable material comprising one or more nonwoven materials containing synthetic fibers.

7. The pouch of claim 1, wherein the back portion further comprises:

a cover extending from the central portion that is configured to cover the opening of the pouch portion.

8. The pouch of claim 1, wherein the pouch portion and the back portion are made from sonically weldable material.

9. The pouch of claim 1, wherein the pouch portion is made of a thermo-formed polymer.

10. The pouch of claim 1, wherein a length of each of the first strap and the second strap is sufficient to encircle a medical gown when in use, and attach the pouch to the medical gown by securing a portion of the first strap to a portion of the second strap.

11. A pouch comprising:

a pouch portion comprising:

a first side and a second side opposite the first side, and a bottom portion disposed between the first side and the second side, the first side, second side, and bottom portion defining an opening;

a top edge and a bottom edge extending in a same direction as the top edge, wherein the top edge is curved, such that that the top edge has a nadir with a height that is lower than each corner of the top edge, and wherein a distance between the first side and the second side is greater than a distance between the top edge and a bottom edge;

a first flange extending outward from first side of the pouch portion;

a second flange extending outward from the second side of the pouch portion, wherein the pouch portion is made of a transparent material and formed by blister or vacuum forming a plastic material;

a back portion comprising a central portion and a peripheral portion surrounding the central portion; and a first strap and a second strap attached to and extending outward from the peripheral portion, wherein the first flange and the second flange are attached to the peripheral portion, wherein the height of the nadir is shorter than a height of the back portion, wherein the first strap, the second strap, and the central portion are integrated into one continuous piece and are formed from a single piece of material, the central portion is wider than the first strap and the second strap, wherein the pouch portion is configured to not collapse onto the back portion, and wherein the first strap and second strap form a waist strap for securing the pouch to a person.

12. The pouch of claim 11, wherein the pouch portion further comprises:

a third flange extending from the bottom portion, the third flange attached to the peripheral portion of the back portion.

13. The pouch of claim 11, wherein the back portion further comprises:

a cover extending from the central portion that is configured to cover an opening of the pouch portion.

14. The pouch of claim 11, wherein the pouch portion and the back portion are made from sonically weldable material.

15. The pouch of claim 11, wherein the pouch portion is made of a thermo-formed polymer.

16. The pouch of claim 11, wherein the pouch portion further comprises:

a loop at a terminal end of the first strap and the second strap.

17. The pouch of claim 11, wherein the back portion is rigid, and the first strap and the second strap are flexible.

* * * * *